United States Patent [19]

Mascher et al.

[11] Patent Number: 4,461,291

[45] Date of Patent: Jul. 24, 1984

[54] RESPIRATOR

[76] Inventors: Werner Mascher, Bismarckstr. 6, 1000 Berlin 41; Klaus Pampuch, Neubrücker Str. 40, 1000 Berlin 28, both of Fed. Rep. of Germany

[21] Appl. No.: 171,941

[22] Filed: Jul. 24, 1980

Related U.S. Application Data

[63] Continuation of Ser. No. 882,120, Feb. 28, 1978, abandoned, which is a continuation-in-part of Ser. No. 762,170, Jan. 24, 1977, abandoned.

[51] Int. Cl.[3] ..... A62B 7/08

[52] U.S. Cl. ..... 128/202.26; 128/205.12

[58] Field of Search ..... 128/202.26, 205.12, 128/205.13, 205.17, 205.28, 206.17; 55/DIG. 33, DIG. 35

[56] References Cited

U.S. PATENT DOCUMENTS

| | | | |
|---|---|---|---|
| 1,814,506 | 7/1931 | Davis | 128/205.17 |
| 2,041,406 | 5/1936 | Foregger | 128/205.12 |
| 2,220,673 | 11/1940 | Bloomheart | 128/205.28 |
| 2,403,981 | 7/1946 | Jackson et al. | 128/202.26 |
| 2,403,991 | 7/1946 | Murphy et al. | 128/205.12 |
| 2,852,023 | 9/1958 | Hamilton et al. | 128/205.12 |
| 3,326,212 | 6/1967 | Phillips | 128/201.21 |
| 3,655,346 | 4/1972 | Cotabish et al. | 128/202.26 |
| 3,980,081 | 9/1976 | Cotabish et al. | 128/207.14 |
| 4,019,507 | 4/1977 | Oetjen et al. | 128/202.26 |

FOREIGN PATENT DOCUMENTS

| | | | |
|---|---|---|---|
| 1910496 | 9/1970 | Fed. Rep. of Germany | 128/202.26 |
| 2641576 | 3/1978 | Fed. Rep. of Germany | 128/202.26 |
| 2,726,405 | 12/1978 | Fed. Rep. of Germany | 128/205.12 |
| 977172 | 3/1951 | France | 128/202.26 |
| 464372 | 4/1937 | United Kingdom | 128/202.26 |
| 488666 | 7/1938 | United Kingdom | 128/202.26 |
| 121665 | 11/1958 | U.S.S.R. | 128/202.26 |
| 195324 | 6/1967 | U.S.S.R. | 128/202.26 |
| 223592 | 11/1968 | U.S.S.R. | 128/202.26 |
| 234870 | 5/1969 | U.S.S.R. | 128/202.26 |
| 248504 | 8/1969 | U.S.S.R. | 128/202.26 |
| 306854 | 7/1971 | U.S.S.R. | 128/202.26 |

*Primary Examiner*—Henry J. Recla

*Attorney, Agent, or Firm*—Parmelee, Bollinger & Bramblett

[57] ABSTRACT

A novel respirator including a chemical cartridge for reacting with moisture and carbon dioxide in exhaled breath to produce oxygen. The oxygen is stored in a breathing sac. The breathing sac communicates with the chemical cartridge through supporting pipes and a channel formed between the outer wall of the chemical cartridge and the inner wall of an associated container. The cartridge and its associated container are positioned on the bottom of the respirator such that the user has ready access to a spent cartridge so that it can be removed quickly and easily and replaced with a fresh cartridge.

6 Claims, 2 Drawing Figures

RESPIRATOR

This is a continuation of application Ser. No. 882,120 filed Feb. 28, 1978 and now abandoned which was a continuation-in-part of application Ser. No. 762,170 filed Jan. 24, 1977 and now abandoned.

FIELD OF THE INVENTION

The present invention relates to a respirator for regenerating the oxygen content of exhaled air and more specifically, to a respirator having a chemical regenerative cartridge removably inserted in a container, the cartridge being positioned such that easy access thereto is provided for quickly removing and replacing said cartridge, the cartridge also forming a channel with its associated container to provide a passageway for the flow of regenerated air.

BACKGROUND OF THE INVENTION

Respirators which chemically regenerate the oxygen content of exhaled air are known to the art. For example, such apparatus are generally disclosed by U.S. Pat. Nos. 4,019,507 (Oetjen et. al.), 3,980,081 (Cotabish et.al.), 2,403,991 (Murphy et.al), 2,403,981 (Jackson et.al.), British Specification No. 488,666 (Regnault) and Russian Specification No. 234,870.

However, none of these references teach or suggest a regenerative respirator which advantageously provides a simple structure which utilizes a single element to simultaneously provide means for supporting a chemical regenerative agent, means for providing ready access to such chemical agent for rapid replacement thereof, and means for directing the flow of regenerated air through the respirator.

Our new invention advantageously utilizes a simple container to simultaneously support a chemical regenerative cartridge, to provide ready access to the cartridge housed therein, and to form a channel with the outer surface of the cartridge itself for directing the flow of regenerated air, thus eliminating the need to provide separate means (i.e. additional pipes or tubes) to perform this function.

A brief discussion of each of the aforementioned prior art references readily demonstrates the novelty and unobviousness of our inventive concept.

(1) The Oetjen apparatus is not a regenerative respirator. It comprises a pure source of oxygen which is released into the respirator. Exhaled air is discarded, not regenerated.

Oetjen is devoid of teaching of means for rapid and easy replacement of the oxygen cartridge.

(2) Although Cotabish recognized the problem that the components of portable respirators are of such small size that they can only sustain life for a very limited time, its proposed solution teaches against our new invention.

Cotabish provides a respirator which can be connected to a large supplemental oxygen regenerative unit after the initial regenerative chemical has become spent.

In contrast, our new invention accomplishes the same result in a more convenient way because it enables the user to easily and rapidly replace a small regenerative cartridge with a fresh one. The cartridges are small and several of them can be easily carried by the user. By successively replacing cartridges, breathing can be sustained for extended time periods.

(3) Russian Specification No. 234,870 does not suggest a respirator having an easily replaceable cartridge, nor the utilization of the structure of such cartridge to form a passageway for directing the flow of air.

(4) Although the Jackson patent discloses a respirator with a removable canister, it is evident from its disclosure that the removal and replacement of such canister requires some involved and complex operations.

Jackson does not use a single breathing tube for both inhaling and exhaling but requires a separate tube for each operation. Also, Jackson does not pass exhaled gas directly to the regenerative agent, but releases the gas beyond the agent. The gas rises and only then comes into contact with the regenerative agent.

Since Jackson does not disclose a container for housing the regenerative agent, it cannot teach or suggest the use of a channel between a chemical cartridge and an associated container for directing the flow of air through the respirator.

(5) The Murphy patent also discloses a removable canister. However, the Murphy apparatus provides means (including valves and tubes) for causing the regenerated air to bypass the canister during the inhalation cycle. This necessarily complicates the operations involved in replacing the canister.

Murphy teaches against our inventive concept, which passes air through the regenerative agent during both the inhalation and exhalation cycles. We have eliminated the need to provide means for bypassing the regenerative cartridge, and thus have simplified the procedure for replacing the cartridge.

It appears from the Murphy drawings that the lid of the canister container can only be opened about 45°. This complicates the changing of the canister since a replacement canister cannot be directly inserted but must be angled into position. In our invention, the lower portion of a container housing the chemical cartridge can be completely removed, thus providing unobstructed access.

Furthermore, Murphy does not teach or suggest the use of a channel formed by the container and canister for directing airflow within the respirator.

(6) The British Specification is directed towards a respirator which is capable of passing pre-determined portions of exhaled air through different chemical agents. It is also primarily concerned with means for cooling the respirator.

It does not teach the use of a channel between the chemical cartridge and container for directing the flow of air. In fact, it does not show any channel linking the cartridge to a storage bag.

The free space between the bottom of the cartridge and its associated container is not used to channel the flow of regenerated air directly to storage means. The air within this open space must be re-passed through the cartridge itself before flowing to the storage means because there is no direct channel passage means provided thereto from this open space.

In contrast, our invention provides direct channel means between the cartridge and storage means. Our channel is formed between the cartridge itself and its associated container, simplifying the overall structure of our respirator.

To summarize, none of the aforementioned prior art shows or suggests our new apparatus which will now be described in greater detail.

SUMMARY OF THE INVENTION

It is an object of the present invention to provide a new, useful, simple and economical regenerative type respirator which provides easy access to a regenerative chemical cartridge for rapidly replacing a spent cartridge with a fresh one.

It is a further object of the invention to provide a regenerative type respirator including simple and economical means for directing regenerated air to a breathing bag for storage.

It is still a further object of the invention to provide a regenerative type respirator having simplified means for directing the flow of stored regenerated air to the user for inhalation.

The inventive concept to be hereinafter disclosed provides a novel, useful and economical regenerative type respirator which advantageously provides all of the innovative features set forth in the aforementioned objectives.

In accordance with the invention, exhaled air to be regenerated is introduced into the respirator through a mouthpiece affixed to the top of a breathing tube. The exhaled air is forced downwardly through the length of the breathing tube which terminates in a chemical regenerative cartridge positioned therebelow. The chemical cartridge has suitable means for insertably receiving the lower portion of the breathing tube and the exhaled air passing therethrough.

This cartridge includes an oxygen liberating carbon dioxide binding chemical therein. These chemicals, which react with the carbon dioxide and moisture present in exhaled breath to produce oxygen, are well known to those skilled in the art. An example of such a compound is potassium superoxide.

The air introduced into the cartridge is forced therethrough from top to bottom by the force of exhalation. While the air passes through the cartridge, the carbon dioxide and moisture present therein are continuously reacting with the regenerative chemical. When the air has completed its passage therethrough, its oxygen content has been replenished to the extent that it can be safely inhaled.

The regenerated air exits from the bottom of the cartridge and enters into a passageway formed by open space separating the outer surface of the cartridge and an associated cartridge container.

The contour of this cartridge container generally follows the contour of the chemical cartridge which is enclosed therein. The container has associated means for separating its inner surface from the outer surface of the cartridge. This separation forms a passageway into which the regenerated air from the cartridge may enter.

Thus, the cartridge container is innovatively utilized to simultaneously perform a dual function. Firstly, the container holds and supports the chemical cartridge pressed in an abutting relationship against the breathing tube thereabove. This assures that the cartridge will continuously receive exhaled air from the breathing tube.

Additionally, the passageway formed between the cartridge and the container is simultaneously used to transmit the regenerated air entering therein to a breathing bag for storage. As the regenerated air is forced out of the cartridge, it enters this passageway (or channel). The passageway follows the lower surface of the cartridge, and in the proximity of the periphery thereof, changes its direction upwardly to then follow the upwardly projecting sidewalls of the cartridge.

Near the top of the cartridge, the passageway turns inwardly to follow the inwardly directed upper surface of the cartridge. The passageway continues inwardly until the area where the cartridge container joins the breathing tube. At this point, the surface of the container advantageously is directed upwardly such that it forms a port for receiving and supporting the breathing tube.

The portion of the passageway which follows the upper surface of the cartridge has means for receiving a small connecting pipe originating from a breathing bag positioned thereabove. This breathing bag stores regenerated air.

To summarize, exhaled air is forced through a regenerative chemical means. The regenerated air is further forced through a passageway formed by the cartridge and an associated container. When the regenerated air reaches the proximity of a breathing bag, a small connecting pipe transmits it into a breathing bag, where it is then stored.

Because the air is forced through the system by only exhalation no additional means are required to perform this function.

The invention is unique because it utilizes the cartridge container to both house and support the cartridge, and to simultaneously provide a passageway for the flow of the regenerated air. The obvious advantage of this embodiment is that it saves the cost of providing separate means for transmitting the regenerated air to the breathing bag. This results in a substantial reduction of the cost required to manufacture the respirator.

The foregoing description has been directed to the respirator in its exhaling mode of operation. The inhaling mode operates exactly in reverse, as will now be described.

The regenerated air stored in the breathing bag is sucked downward through the connecting pipe by the force of inhalation. This air enters the passageway formed by the cartridge and its associated container and is sucked downwardly through said passageway and into the bottom of the cartridge. The air continues traveling upwardly through the cartridge, into the breathing tube and out the mouthpiece, to be inhaled.

The use of the identical structure for both inhalation and exhalation results in a significant economic advantage in the manufacture of the respirator because no additional means to connect the breathing bag to the breathing tube are required. Additionally, a single breathing tube can be used for both the inhalation and exhalation mode of operation of the respirator.

The present invention however provides yet another novel feature in that replacement of a spent chemical cartridge can be accomplished rapidly and simply as follows:

The portion of the cartridge container which follows the lower surface of the cartridge is detachably affixed to the sidewalls of the container by quick release fasteners. Access to the cartridge is readily obtained by simply removing this lower surface of the container. The cartridge itself is then removed by a slight downward exertion of force thereon.

The replacement cartridge is then pushed upwardly until it engages in insertable relationship with the breathing tube. The lower surface of the container is then replaced by re-engaging the quick release fasteners.

This entire replacement operation can be performed in a very short time.

The concept of the invention also includes variations of the above features. For example, instead of detachably affixing only the lower surface of the container to its side portions, the lower surface and the side portions can be one integral piece. In this embodiment, both the lower surface and sidewalls of the container will be detachably affixed to the upper surface of the container. This can be helpful because more of the cartridge to be removed is exposed, thus making it easier to grasp.

The inventive concept herein described provides a novel, efficient, and simple regenerative respirator solving and simplifying many of the problems encountered by the previously discussed prior art.

DETAILED DESCRIPTION OF THE DRAWINGS

Structure of the Respirator

Figure 1:
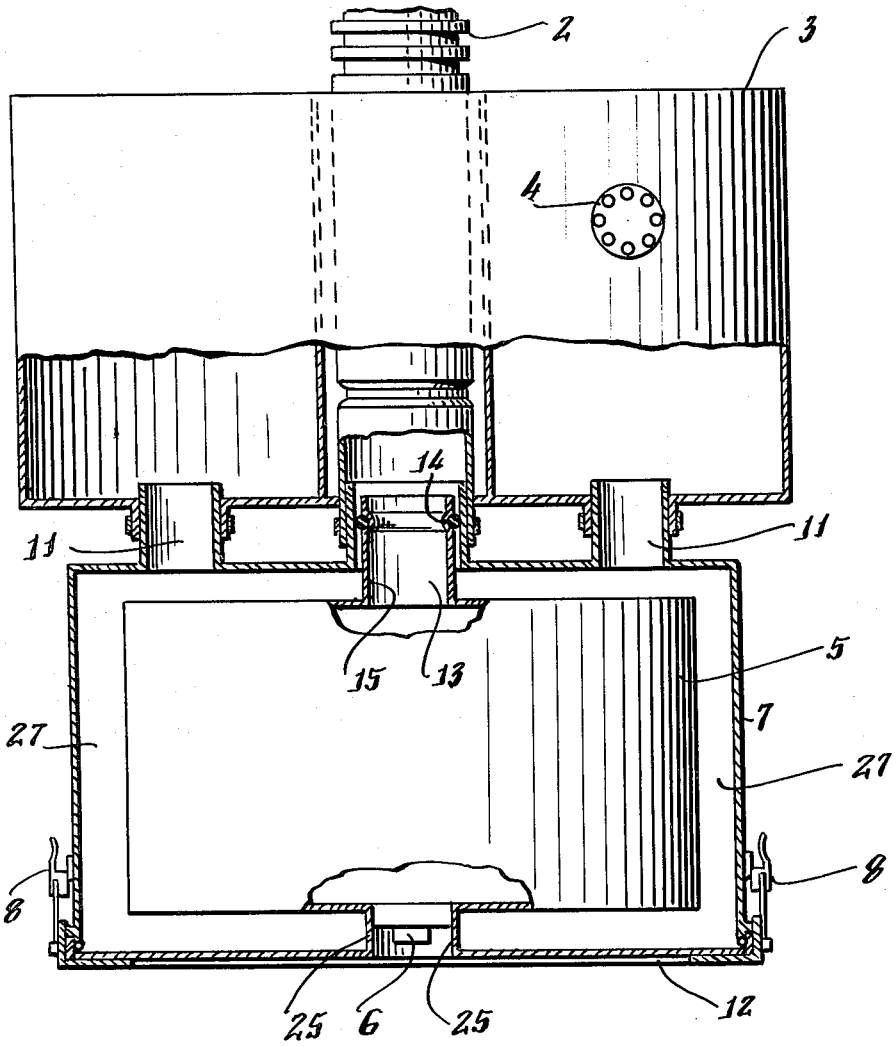
FIG. 1 shows a front elevation view of an embodiment of the present invention.
Figure 2:
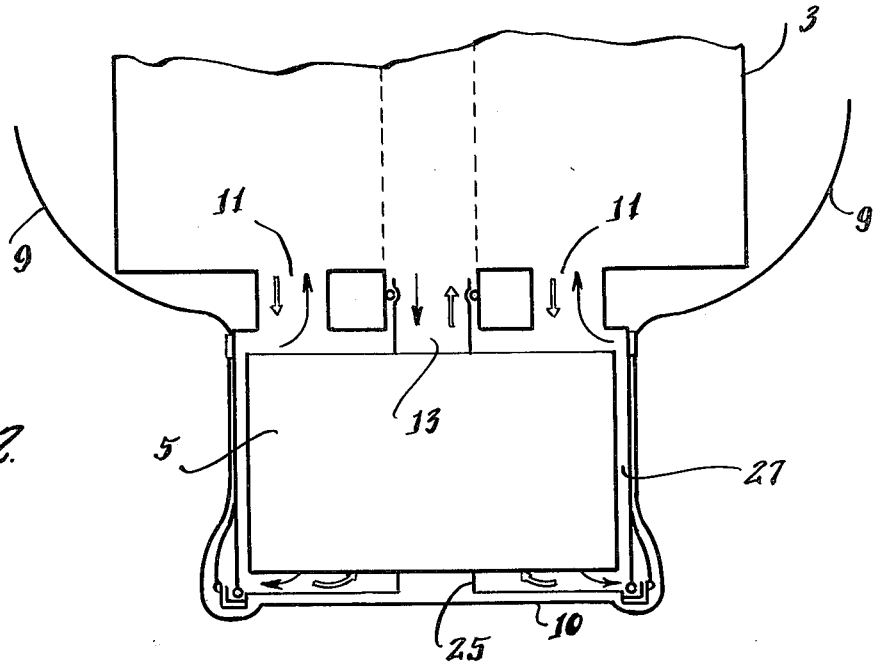
FIG. 2 illustrates the direction of air flow through the embodiment shown in FIG. 1.

Referring specifically to the drawings, FIGS. 1 and 2 illustrate one embodiment of our invention.

A mouthpiece (not shown) is mounted on a breathing tube 2. The breathing tube 2 passes through the approximate center of breathing bag 3 and continues therethrough until it joins the tube ending 15 in insertable relationship. Gaskets 14 are provided where tube ending 15 meets breathing tube 2 to seal this junction. Tube ending 15 is carried by the upper surface of chemical cartridge 5 and leads therein.

Chemical cartridge 5 is generally enclosed within a container designated as 7. The upper surface of the container 7 has aperture 13 for receiving the breathing tube 2 and guiding it towards the chemical cartridge 5. As shown in FIG. 1, a separate tube ending is received in the lower end of the breathing tube 2 abuts against the upper surface of the chemical cartridge 5.

The upper surface of container 7 additionally has other apertures, each of which receives one end of connecting pipes 11. The other end of these connecting pipes are received directly by breathing bag 3. Thus, the connecting pipes 11 form channels between the upper surface 7 of the container and the breathing bag 3.

Chemical cartridge 5 is received and supported within the container 7. Specifically, the lower surface of chemical cartridge 5 is supported by the upwardly directed vertical supporting members 25 carried on the lower surface 12 of the container 7.

The contour of container 7 generally follows the contour of chemical cartridge 5. The vertical supporting members 25, in addition to supporting the chemical cartridge 5, also maintains the container's lower surface 12 separated from the lower surface of the cartridge 5 by a constant distance. The sidewalls and upper surface of the container 7 are also maintained approximately the same distance away from their corresponding portions of the outer surface of the chemical cartridge 5.

Thus, the inner wall of the container and the corresponding outer wall of the chemical cartridge form a passageway or channel generally shown as 27. Channel 27 runs adjacent to lower surface, sidewalls and upper surface of the container. It connects the chemical cartridge's lower surface with the connecting pipes 11, thereby forming a direct passageway to the breathing bag 3.

Lower surface 12 of container 7 is detachably affixed to the sidewalls of the container by suitable fastening means, such as quickly releasable clips 8. The importance of this feature will become evident when it is discussed below in relation to the changing of the chemical cartridge.

FIGS. 1 and 2 also show some various additional features of this embodiment of the invention. A quickstarter 6 is positioned near the center of the lower surface of the chemical cartridge. When first using the respirator, the quickstarter can be actuated to immediately release oxygen into the system.

Element 4 is an over pressure valve carried on the surface of the breathing bag 3. In the event that too much pressure is being exerted on the breathing bag by the air stored therein, the over pressure valve can be actuated to release some of the air.

Element 10 is a bag for carrying the respirator. Element 9 is a carrying strap which is affixed to carrying bag 10. The bag and the strap enable the user of the respirator to wear it on his body.

Operation of the Respirator (A) Exhalation Mode Of Operation

The operation of the respirator will now be described with reference to FIGS. 1 and 2 of the drawing. The dark arrows in FIG. 2 represent the exhalation mode of operation while the lighter arrows represent the inhalation mode.

Exhaled air forced into the respirator through the mouthpiece and the breathing tube 2 communicates with the chemical regenerative cartridge through aperature 13.

An oxygen liberating carbon dioxide binding chemical means is present within the cartridge. Such chemicals, which are known to those skilled in the art, react with the carbon dioxide and moisture present in the exhaled breath to produce oxygen.

After passing through cartridge 5, the now regenerated air exits from the lower surface thereof and is received by channel 27 formed between the outer surface of the cartridge 5 and the inner surface of container 7 in the proximity of lower surface 12 of the container.

The regenerated air continues to flow through the channel along the outer surface of the cartridge until it reaches connecting pipe 11. The force of exhalation forces the air through connecting pipe 11 and into breathing bag 3 thereabove. The breathing bag stores the regenerated air, completing the exhalation cycle.

(B) Inhalation Mode Of Operation

The inhalation cycle is identical to the aforementioned exhalation cycle except that its steps occur in reverse order.

When the user of the respirator inhales into the mouthpiece, a force is exerted on the air in the breathing tube drawing the regenerated air out of the breathing bag through connecting pipe 11.

This air is received by channel 27 formed between the container and the cartridge and drawn through the channel until it is received by the bottom of the chemical cartridge 5. The air is drawn upwardly through the chemical cartridge, into and up the breathing tube, and out the mouthpiece, to be inhaled by the user.

The advantages and improvements of this embodiment of the respirator thus far described are evident and can be summarized as follows:

The invention advantageously uses the cartridge container 7 simultaneously to receive and support the cartridge and to also provide a passageway connecting the cartridge to the breathing bag. This eliminates the need for providing separate means for making such connection, thus markedly simplifying the manufacture of the respirators. This, in turn, reduces the costs of such respirators.

Furthermore, because the same structure is used for both the inhalation and exhalation modes of operation, no additional components to separate these two modes are required. The prior art described before used various means (such as tubes, valves, etc.) to have the regenerated air bypass the chemical cartridge during the inhalation mode of operation. The present invention teaches that the air can be passed through the chemical cartridge during both the exhalation and inhalation modes, thus eliminating the need for any equipment to bypass the cartridge. This feature further simplifies the manufacture of the respirator and reduces costs.

An additional advantageous feature of the invention is that the cartridge can readily and easily be removed and replaced whenever necessary. The lower surface 12 of the container 7 is detachably affixed to the sidewalls of the container by quick release fasteners 8. By applying slight force to these fasteners, the lower surface 12 can be entirely removed from the container.

Once lower surface 12 is removed, cartridge 5 is exposed and accessible. It can then be easily removed by a downward pull. Once removed, a replacement cartridge is pushed upwardly such that its tube ending 15 insertably engages with the lower portion of breathing tube 3. Thus, lower surface 12 is snapped back into its original position, completing the replacement operation.

The entire replacement operation is quite simple and can be done in a minimal amount of time. This feature is of critical importance when the user of the respirator must quickly replace a spent cartridge.

In addition to other features, our respirator adds a regenerative cartridge to a container and produces a cartridge housed within the container and a channel which is efficiently utilized for directing the flow of regenerated air to and from the cartridge.

The prior art adds a regenerative cartridge and a container and produces only a cartridge housed within the container. Separate means must be provided to direct the flow of air to and from the cartridge.

The description of the invention provided herein is meant to be only illustrative and not restrictive of the scope of the invention, said scope being defined by the following claims and all equivalents thereto.

We claim:

1. A respirator for regenerating oxygen in exhaled air which is suitable to be safely inhaled comprising a cartridge containing chemical means therein for trapping carbon dioxide and moisture in exhaled air and releasing oxygen therefrom;

a housing having an upper surface, a lower surface and sidewalls, said housing adapted to receive said cartridge therein;

means for removably mounting said cartridge in said housing such that said cartridge is spaced at least from said lower surface and said sidewalls of said housing to define only one channel having a single continuous flow path between said cartridge and said lower surface and said sidewalls of said housing, at least one portion of said channel communicating directly with said cartridge in fluid flow relationship therewith;

a breathing tube having one end connectable to a user and the opposite end thereof removably fluidly connectable to said cartridge;

a breathing bag coupled in fluid flow relationship to said only one channel defined between said cartridge and housing to define only one bi-directional flow path between said breathing tube, said cartridge, said channel and said breathing bag, whereby exhalation of air through said breathing tube applies regenerated oxygen from said cartridge through said channel and to said breathing bag, and inhalation through said breathing tube removes oxygen from said breathing bag which is carried through said channel, through said cartridge, and through said breathing tube;

said housing including a tubular extension affixed to the upper surface thereof, said opposite end of said breathing tube being mounted on said tubular extension, said cartridge including tube means extending therefrom in alignment with said tubular extension, said tube means being slidably and sealingly inserted within said tubular extension;

said breathing bag being coupled to said channel by at least two separate passageways defined on the upper surface of said housing, each of said passageways being located on opposed sides said breathing tube;

all air exhaled into said breathing bag or inhaled from of said breathing bag passing through said channel and said cartridge;

said lower surface of said housing being removably mounted on said housing whereby said cartridge can be quickly and easily removed from said housing through the bottom of said housing.

2. The respirator set forth in claim 1 wherein the spacing between said sidewalls and said housing is annular.

3. The respirator set forth in claim 1 or 2 having retainer means defined on said lower surface of said housing positioned beneath said cartridge for spacing the lower surface of said cartridge from the lower surface of said housing.

4. The respirator set forth in claims 1 or 2 in which said upper surface of said housing is spaced from said cartridge and said space between said upper surface and said cartridge is in communication with said channel defined between said cartridge and said sidewalls and said lower surface of said housing, said breathing bag being coupled to the space between said upper surface and said cartridge.

5. The respirator set forth in claims 1 or 2 in which said breathing bag is positioned above the upper surface of said housing above said cartridge.

6. The respirator set forth in claims 1 or 2 in which breathing bag is positioned above said cartridge and surrounds said breathing tube.

* * * * *